US005800892A

United States Patent [19]

Yee

[11] Patent Number: 5,800,892

[45] Date of Patent: Sep. 1, 1998

[54] PLASTIC CLOISONNE ARTICLE AND METHOD OF MAKING SAME

[76] Inventor: William F. Yee, 140 Woodland Ave. P.O. Box 26, Rochelle Park, N.J. 07662

[21] Appl. No.: 792,927

[22] Filed: Jan. 21, 1997

[51] Int. Cl.[6] ..... B44F 1/06

[52] U.S. Cl. ..... 428/38; 156/63

[58] Field of Search ..... 428/7, 38; 206/575; 156/63

[56] References Cited

U.S. PATENT DOCUMENTS

| | | | |
|---|---|---|---|
| 3,619,456 | 11/1971 | Taylor | 428/38 X |
| 3,839,080 | 10/1974 | Jarema et al. | 428/312.2 |
| 4,016,235 | 4/1977 | Ferro | 428/38 X |
| 4,139,667 | 2/1979 | Blue | 428/38 |
| 4,275,028 | 6/1981 | Cohen | 428/38 X |
| 4,342,611 | 8/1982 | Tuttle | 428/38 X |
| 4,447,473 | 5/1984 | Mashida et al. | 428/204 |
| 4,597,146 | 7/1986 | Larin | 40/1.5 X |
| 4,655,981 | 4/1987 | Nielsen et al. | 264/162 |
| 4,869,940 | 9/1989 | Shoshani | 428/38 |
| 5,558,827 | 9/1996 | Howes | 428/38 X |
| 5,624,510 | 4/1997 | Uchida et al. | 427/198 X |

*Primary Examiner*—Henry F. Epstein
*Attorney, Agent, or Firm*—Friscia & Nussbaum

[57] ABSTRACT

A plastic cloisonne article and method of making same is provided. The plastic cloisonne article includes a plastic substrate which can be pre-molded into a fixed shape, a framework of metal wire for forming a design on the plastic substrate, one or more colored glazes, and a clear glaze which covers the outer surfaces of the colored glazed plastic substrate. The plastic substrate is preferably comprised of a high density polystyrene, polyprophylene, polyurethane or polyethylene which has a high melting point and is sufficiently rigid to withstand the temperature of firing. The plastic cloisonne article can be formed into such shapes which include, but are not limited to, ornaments, Christmas ornaments, boxes, vases, picture frames, coasters, etc.

15 Claims, 2 Drawing Sheets

PLASTIC CLOISONNE ARTICLE AND METHOD OF MAKING SAME

BACKGROUND OF THE INVENTION

1. Field of the Invention

This invention generally relates to a plastic cloisonne article and the method of making same, and more particularly to a cloisonne article having a plastic base or substrate.

2. Related Art

Cloisonne articles such as ornaments, boxes, vases, etc., are conventionally manufactured by attaching a metal wire framework to a metallic substrate. In regions outlined by the particular pattern of metal wire which comprises the framework, colored glaze is applied. Thereafter, the article is coated with a transparent glaze and then fired at a high temperature, typically in a kiln.

Traditionally, the base body or substrate of the decorative ornament has been copper, but alternative metals such as silver, gold, iron, steel and alloys therefrom have also been used. The metallic substrate significantly adds weight to the decorative article and limits the applications under which it can be displayed. For example, a hanging Christmas tree ornament would be too heavy to hang from a branch of a Christmas tree without unduly bending the branch. Additionally, this weight increases the cost of shipping the article. Also, a metallic substrate increases the overall cost of the decorative article since the cost of the metal is typically higher than other readily available materials such as plastic or recycled plastic.

Accordingly, what is needed, and has not heretofore been developed, is a lightweight cloisonne article and method of making same.

Examples of previous efforts at decorative cloisonne articles include:

Howes, U.S. Pat. No. 5,558,827 (1996) discloses a decorative multipane window as a replica having a thick translucent layer of plastic resin layer molded onto a sheet of glass. The method for making the decorative window comprises the steps of coating the glass sheet with an adherent material and clamping a mold, having a flat peripheral region and an inwardly extending cavity, to the glass sheet. Subsequently, the internal cavity of the mold is filled with a catalyzed transparent plastic resin including the adherent material and allowing the resin to cure within the internal cavity. After the resin cures, the mold is removed. Lastly, a curable viscous fluid, which is a resin simulating conventional came or metallic connecting rod pieces of a conventional leaded glass window, is applied to the molded multipanes.

Shoshani, U.S. Pat. No. 4,869,940 (1989) discloses decorative plastic products having patterns which are produced by coating the metal surface of a metal clad laminate with a photosensitive emulsion or film, superimposing a photographic negative of the required pattern on the photo sensitive coating, exposing the coating to ultraviolet light to produce a photographic positive, removing the unprotected metal areas by acid treatment and, if desired, removing the hardened photosensitive coating.

Nielsen et al., U.S. Pat. No. 4,655,981 (1987) discloses a method of producing a decorative pattern on the surface of a layer of soft, plastic material. The method comprises whipping the soft surface by the free end portions by a plurality of flexible thread-like members to make depressions in the plastic material. Once the depressions have been formed the plastic material is hardened, cured or set. Often, the hardened plates are used as roofing plates.

Larin, U.S. Pat. No. 4,597,146 (1986) discloses a method of making lead, tin or zinc based alloy badges or emblems containing cloisonned areas into which colors can be introduced. The cloisonned areas are molded under pressure into the alloy of the substrate other alloys such as pewter and linotype which have minutely porous surfaces into which paint penetrates to provide a painted thickness of substantial depth.

Mashida et al., U.S. Pat. No. 4,447,473 (1984) discloses a method of producing decorative objects on which a light-interference surface layer shows a design that is produced by the steps of forming an oxidized metallic thin film on a glazed and baked surface of a substrate. The substrate is formed from metals such as copper, iron gold, silver, or steel as well as ceramics such as china and porcelain. The degree of oxidation of the metal film is controlled according to the desired pattern or design. At high temperatures, the metal oxide layer is dissolved into the glazing compound which covers the design and underlying substrate.

Tuttle, U.S. Pat. No. 4,342,611 (1982) discloses a process for producing stained glass objects comprising the steps of moistening a length of a glue impregnated string, placing the string onto a glass or plastic object to be permanently affixed. Once affixed in place, a liquid colored stain is poured into the defined areas and allowed to dry.

Cohen, U.S. Pat. No. 4,275,028 (1981) discloses a plastic ornament and a method for making same wherein multiple plastic pellets are placed in the holes of a mesh, one pellet to each hole, according to a predetermined pattern. The pellets and mesh are heated until the pellets begin fusing together. The mesh is removed. The pellets may be heated further until the plastic ornament achieves the desired smoothness.

Blue, U.S. Pat. No. 4,139,667 (1979) discloses an artwork creation in which gemstones are positioned on a laminated backing sheet and corralled with a cloisonne framework formed from a precious metal. The gemstones, and any related articles of jewelry, are equipped with clasps which fit into perforations made into the backing material.

Ferro, U.S. Pat. No. 4,016,235 (1977) discloses a method of making simulated stain glass from a moldable plastic material. In making the stain glass design a plastic film having a series of dark colored interconnected strips is held in place by a vacuum against the die surface while a moldable plastic resin is injected into the die cavity. The heat and pressure generated by the exothermic reaction of the resin acts to mold the dark colored strips into pre-cut recesses while the resin itself fuses to the surface of the plastic film to provide a composite structure which resembles stained glass.

Jarema et al., U.S. Pat. No. 3,839,080 (1974) discloses a plastic coated metallic foam. The coating is an organopolymer that can be employed singly or in combination of multiple resins to form laminar coats.

Taylor, U.S. Pat. No. 3,619,456 (1971) discloses an assembly made from plastic but which appears to be stained glass in lead and a method for making same. In making the assembly, horizontally grooved plastic canes are positioned on a horizontal surface in the framework of the desired design. The design is then filled with a filler material to the bottom of the grooves electrolyte composition and a method of using same. Various colored liquid plastics are poured into the design to fill it to the top of the grooves. The liquid plastic cures and the filler material is removed.

None of these previous efforts disclose all of the benefits of the present invention, nor do these previous patents teach or suggest all of the elements of the present invention.

OBJECTS AND SUMMARY OF THE INVENTION

It is a primary object of the present invention to provide a cloisonne article having a plastic substrate.

It is also an object of the present invention to provide a cloisonne article that is lightweight.

It is an additional object of the present invention to provide a lightweight cloisonne ornament that can be hung from a Christmas tree.

It is also an object of the present invention to provide a plastic cloisonne ornament that is lighter in weight than a traditional cloisonne ornament having a metal substrate.

It is also an object of the present invention to provide a cloisonne article having a substrate which can be easily molded into a desired shape.

It is an additional object of the invention to provide a cloisonne article having a plastic substrate which can be formed into a desired shape by injection molding.

It is another object of the present invention to provide a plastic cloisonne article that is easy to manufacture.

It is even another object of the present invention to provide a plastic cloisonne article which is inexpensive to manufacture.

It is still another object of the present invention to promote a plastic cloisonne article that is relatively inexpensive to ship.

These and other objects are achieved by the plastic cloisonne article of the present invention which comprises a plastic substrate formed into a desired shape; a framework of metal strips or wires which forms a design on the substrate; means for attaching the metal wires onto the substrate; one or more colored glazes for coloring the design; and a clear glaze. The method of making the cloisonne article of the present invention comprises the steps of forming a substrate of plastic; attaching a metal wire framework design to the plastic substrate; applying colored glaze to color the design; buffing or polishing the framework and colored glaze to brighten the metal and smooth the surface of the colored glaze; applying a clear glaze over the article; and firing the article.

BRIEF DESCRIPTION OF THE DRAWINGS

Other important objects and features of the invention will be apparent from the following Detailed Description of the Invention when read in context with the accompanying drawings in which.

DETAILED DESCRIPTION OF THE INVENTION

The present invention relates to a plastic cloisonne article and a method of making same. Rather than use a metal or metal alloy for a substrate as is conventionally known, the article and method of the present invention are directed to a cloisonne article having a plastic substrate.

Figure 1:
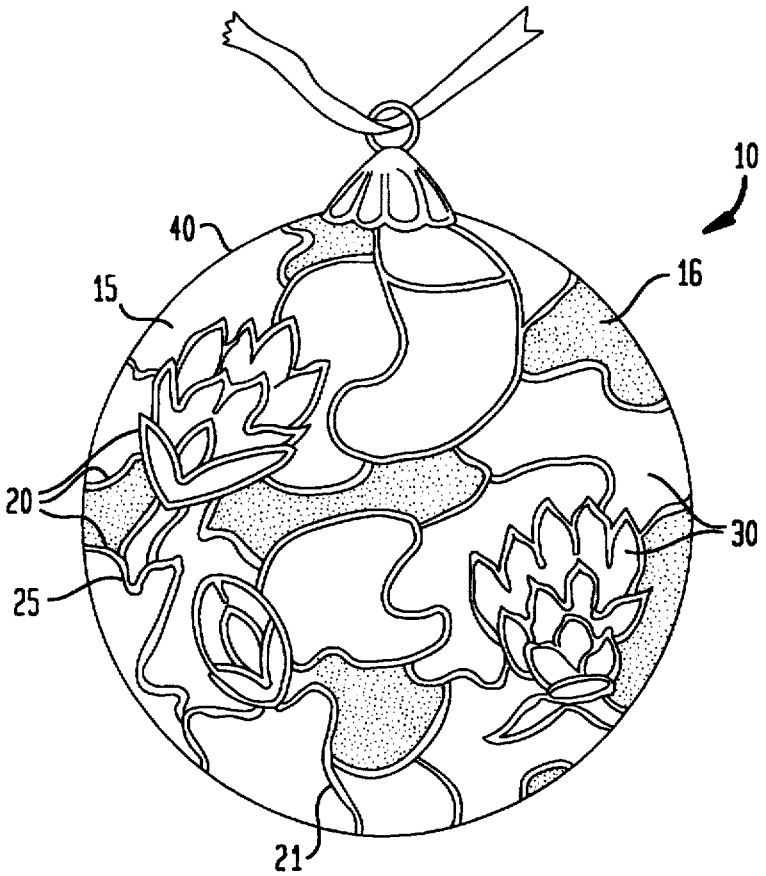
FIG. 1 is a side plan view of a plastic cloisonne article of the present invention.

As shown in FIG. 1, the plastic cloisonne article, generally indicated at 10, comprises a plastic substrate 15, a framework 20, an attachment means 25 for securing the framework 20 to the plastic substrate 15, at least one colored glaze 30 and a clear glaze 40.

The plastic substrate 15 forms the base or body of the article 10. In the past, a metal such as copper was used as the substrate for a traditional cloisonne article. The main benefit of using a plastic substrate is savings in the weight of the article which translates to reduced shipping costs. Additionally, a lighter weight article has extended utility as a hanging Christmas tree ornament wherein it is beneficial to provide a light weight ornament that does not bend a tree branch as much as a heavier ornament. The plastic substrate 15 is preferably comprised of a high density, rigid, polymer having a relatively high melting point, such as polystyrene, polyprophylene, polyurethane or polyethylene. Importantly, the polymeric material must be able to withstand the heat of firing the article. The shape of the substrate is formed by injection molding, or by any suitable process known in the art.

The substrate 15 has an exterior surface 16 which is able to maintain its pre-molded shape at the temperatures achieved during conventional kiln firing. Also, the plastic substrate 15 may be pre-formed, pre-cut, or otherwise detailed about its exterior surface 16, by methods which are known in the art, prior to its incorporation into the plastic cloisonne article 10. Such shapes include, but are not limited to, ornaments, Christmas ornaments, boxes, vases, picture frames, coasters, lamps and/or parts thereof, wall hangings, animals, etc. Further, the plastic substrate 15 may be drilled, perforated or otherwise shaped to provide for ventilation during firing and to allow for the attachment of any hooks, straps or ancillary ornamentation which may be desired.

The framework 20 is a collection of connected metal wires or strips 21, preferably brass wire materials, which are suitably arranged to form a design. An exact fit between adjacent metal strips 21 is not necessary. The attachment means 25 for attaching the metal strips 21 to the substrate 15 comprises an adhesive, preferably a water base glue. Such attachment means, as is known in the art, has substantial adhesive properties for bonding the metal strips 21 of the framework 20 to the exterior surface 16 of the plastic substrate 15.

Once the framework 20 has been attached to the exterior surface 16 of the plastic substrate 15, the design formed by the framework may be colored with colored glaze 30. The colored glaze 30 may be applied with a paint brush or by any other means as is known in the art. Preferably, a ceramic glaze of a low temperature is used. Importantly, the temperature of the glaze 30 cannot exceed the melting point of the plastic substrate 15. After the colored glaze 30 dries, the article is buffed or polished, as is known in the art, to shine-up the metal wires and to smooth-out the colored glaze.

After the colored glaze 30 has been applied and allowed to dry, a clear glaze 40 is applied over the framework 20 and the colored glaze 30. Suitable clear glazes include those used for china or porcelain, as well as glazes for metals such as enamel or conventional cloisonne glaze, and may be applied using conventional techniques, such as spraying, painting or brushing, as is practiced in the art.

Thereafter, the glazed article 10 is kiln fired in an electric kiln or an open coal fire or otherwise as is known in the art.

Figure 2:
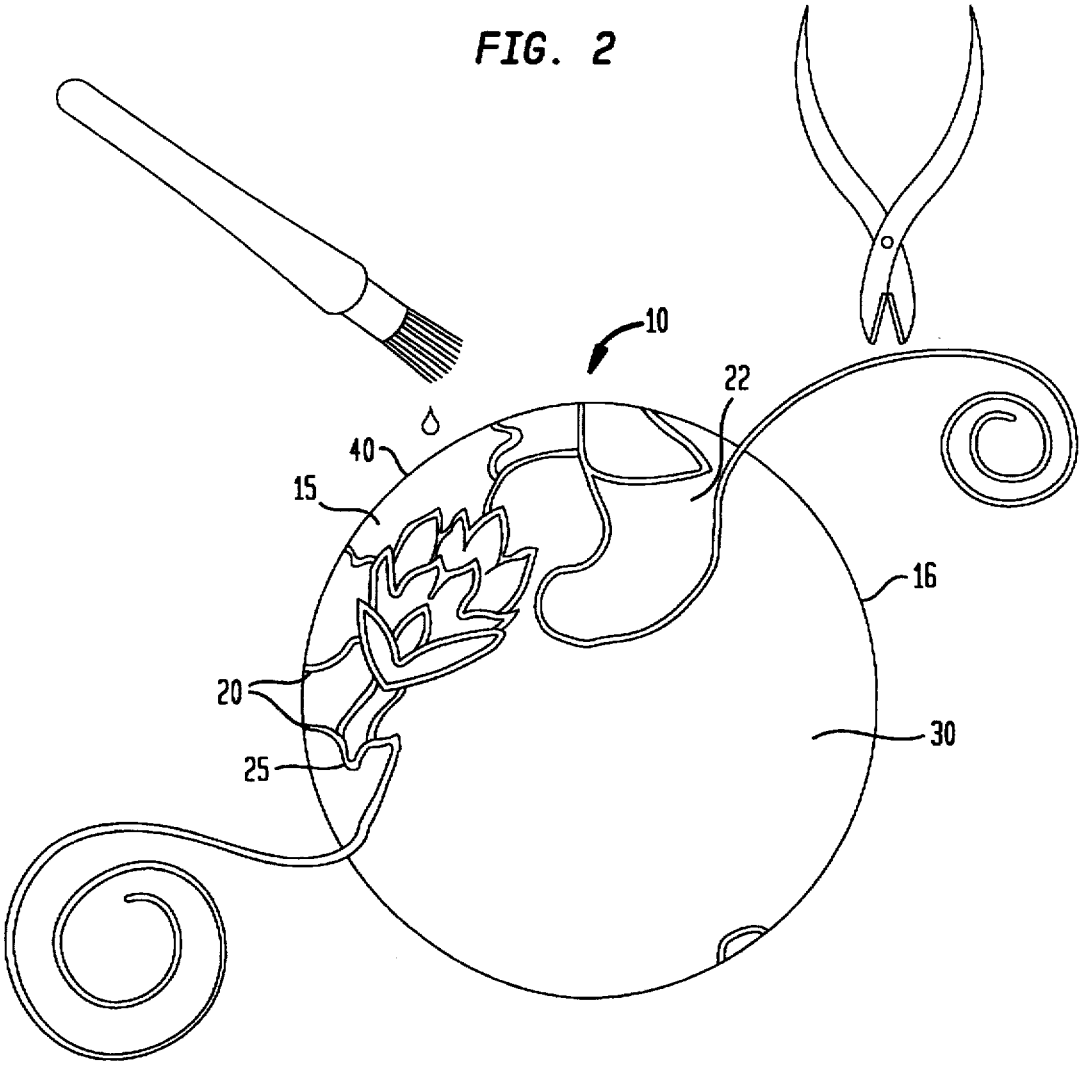
FIG. 2 is a side plan view of a partially completed plastic cloisonne article shown in FIG. 1.

As illustrated in FIG. 2, the method of making the plastic cloisonne article of the present invention comprises the steps of molding or otherwise forming the plastic substrate 15 into the desired shape of the article 10; cutting metal wire or strips 21; forming a design by attaching the metal wire strips 21 onto the plastic substrate 15; attaching the metal wire or strips 21 to the plastic substrate 15 by an adhesive or other attachment means 25; applying colored glaze 30 to color the design formed by the metal strips 21; allowing the colored glaze to dry; buffing or polishing the glazed article; applying clear glaze 40 to the article 10; and firing the article 10. The method may also include the step of attaching ancillary ornamentation once the article. Further, the method may include the step of drilling or otherwise forming a hole in the article to permit ventilation during firing. Thereafter, the same hole may be used to anchor a hook or other attachment to the article to facilitate the display thereof Additionally, the aforementioned components which comprise the plastic cloisonne article 10 may be sold as a kit of unassembled parts with appropriate assembly instructions. The components of the kit could be combined in the manner described above to create an ornament having all the features, characteristics and attributes of a traditional cloisonne work of art, but the ornament will have a lighter weight than if a copper or other metallic type of alloy was used to form the substrate 15. Such a kit could contain a pre-formed plastic substrate; metallic wire either in the form of a roll or in pre-cut pieces; adhesive means for attaching the wire to the substrate to form a design; colored glaze for coloring the design; means for buffing or polishing the article; and clear glaze means for coating the article. Additionally, hook or other attachment or display means could be provided to allow for display of the article.

Having thus described the invention in detail, it is to be understood that the forgoing description is not intended to limit the spirit and scope thereof. What is desired to be protected by the Letters Patent is set forth in the appended claims.

What is claimed is:

1. A light weight decorative cloisonne article comprising:

a plastic substrate;

a metal framework attached to the plastic substrate;

means for attaching the framework to the plastic substrate;

colored glaze means for coloring the article; and clear glaze means to finish the article.

2. The cloisonne article of claim 1 wherein the plastic substrate can withstand temperatures of kiln firing.

3. The cloisonne article of claim 2 wherein the framework forms a design on the plastic substrate.

4. The cloisonne article of claim 3 wherein the framework comprises of a plurality of metal strips.

5. The cloisonne article of claim 3 wherein the framework comprises metal wire.

6. The cloisonne article of claim 3 wherein the means for attaching the framework to the substrate comprises a water base glue.

7. The cloisonne article of claim 3 wherein the plastic substrate is spherical and includes a hook for use as a Christmas tree ornament.

8. The cloisonne article of claim 3 wherein the plastic substrate is formed into a desired shape by injection molding.

9. The cloisonne article of claim 8 wherein the plastic substrate is comprised of high density polystyrene which is sufficiently rigid to withstand firing.

10. The cloisonne article of claim 8 wherein the plastic substrate is comprised of high density polyprophylene which is sufficiently rigid to withstand firing.

11. The cloisonne article of claim 8 wherein the plastic substrate is comprised of high density polyurethane which is sufficiently rigid to withstand firing.

12. The cloisonne article of claim 8 wherein the plastic substrate is comprised of high density polyethylene which is sufficiently rigid to withstand firing.

13. A method of making a light weight cloisonne article comprising the steps of:

forming a plastic substrate into a desired shape;

forming a metallic framework into a design;

attaching the metallic framework onto the plastic substrate to form a design on the plastic substrate;

applying colored glaze to the design;

allowing the colored glaze to dry;

polishing the article;

coating the article with clear glaze; and curing the article.

14. The method of claim 13 wherein the step of curing the article comprises firing the article.

15. The method of claim 14 wherein the article comprises a hanging ornament and the method of making same further comprises the step of forming a vent means in the plastic substrate and attaching a hook to the ventilation means for hanging the article.

* * * * *